US007129705B1

(12) United States Patent
Accumanno

(10) Patent No.: US 7,129,705 B1
(45) Date of Patent: Oct. 31, 2006

(54) IGNITION SPARK TESTER

(75) Inventor: Mario Bernardo Accumanno, East Hanover, NJ (US)

(73) Assignee: M. Eagles Warehouse, Inc., Newark, NJ (US)

( * ) Notice: Subject to any disclaimer, the term of this patent is extended or adjusted under 35 U.S.C. 154(b) by 0 days.

(21) Appl. No.: 11/280,587

(22) Filed: Nov. 17, 2005

(51) Int. Cl.
*F02P 17/00* (2006.01)

(52) U.S. Cl. ..... 324/399; 324/400

(58) Field of Classification Search ..... 324/399, 324/400

See application file for complete search history.

(56) References Cited

U.S. PATENT DOCUMENTS

| | | | | |
|---|---|---|---|---|
| 2,853,691 | A | 9/1958 | McCord | |
| 3,497,798 | A | 2/1970 | Schick | |
| 4,026,621 | A | 5/1977 | Korba | |
| 5,245,324 | A * | 9/1993 | Jonker et al. | 345/440.1 |
| 5,537,983 | A | 7/1996 | Nakajima | |
| 5,599,195 | A | 2/1997 | Mitani et al. | |
| 5,706,792 | A | 1/1998 | Boyer et al. | |
| 6,068,495 | A | 5/2000 | Virchow | |
| 6,249,123 | B1 * | 6/2001 | Rankin | 324/393 |
| 6,714,015 | B1 | 3/2004 | Whitehead | |
| 6,817,872 | B1 | 11/2004 | Berg | |
| 2004/0182137 | A1 * | 9/2004 | Kang | 73/49.7 |

OTHER PUBLICATIONS

S&G Prior Art.

* cited by examiner

*Primary Examiner*—Vincent Q. Nguyen
(74) *Attorney, Agent, or Firm*—Harold James; Epstein Drangel Bazerman & James, LLP

(57) ABSTRACT

A device for testing the functioning in an internal combustion engine of spark plugs which are recessed within the cylinder head. Connection to the recessed spark plugs can be accomplished by an elongated device shaped to fit within and extend beyond the spark plug recess, preferably with a secure frictional fit within that recess and preferably designed with portions of different diameters so that, by inverting, the unit can be used with cylinder head recesses with a wide range of internal diameters. The device may, if desired, carry a shield member adapted when the device is in use to cover the exposed top of the recess, thereby to prevent foreign material from entering the recess while ignition system testing is carried out. The device may be readily combined with other devices to constitute a kit of virtually unrestricted testing capacity.

14 Claims, 3 Drawing Sheets

IGNITION SPARK TESTER

The present invention relates to improvements in equipment for testing the functioning of spark plugs in an internal combustion engine.

BACKGROUND OF THE INVENTION

Internal combustion engines have spark plugs which are electrically connected to ignition coils which provide properly timed electric signals to the spark plugs when the engine is running. In the course of determining the cause of a particular malfunction of an engine it often becomes necessary to determine whether or not a particular spark plug is in fact being properly energized from the ignition coil. To that end it has been common to disconnect the usual electric connection between the ignition coil and the spark plug and replace it with a testing device such as an illuminable bulb which will indicate whether the spark plug is receiving the proper signals from the ignition coil and to insert that device between the ignition coil and the spark plug under test. The testing device is provided with electrical connectors at each end which may be connected to the spark plug and the ignition coil respectively and which, when the testing is completed, may be disconnected therefrom, after which the normal electrical connection between the ignition coil and the spark plug is reestablished. Typical patents showing such testing devices are Whitehead U.S. Pat. No. 6,714,015 of Mar. 30, 2004, entitled "Apparatus for Testing Spark Plugs", Mitani, et al. U.S. Pat. No. 5,599,195 of Feb. 4, 1997, entitled "Ignition Plug Cap", McCord U.S. Pat. No. 2,853,691 of Sep. 23, 1958, entitled "Tune-up Extension for Use With Spark Plugs for Testing Purposes", and Korba U.S. Pat. No. 4,026,621 of May 31, 1997, entitled "Timing Light Adapter". The aforementioned '015 patent discloses in FIGS. 1 and 2 units of the type under discussion previously sold by the assignee of this application.

Spark plugs have at their upper ends exposed male electrical contacts so that a female connector may be readily attached thereto and detached therefrom, and the testing devices of the prior art have therefore been provided with female connectors which may be pressed onto male spark plug contacts when testing is required. In the past spark plugs were mounted on the cylinder head so that their male contacts were readily accessible. However, in more modern internal combustion engines the spark plugs are housed within deep recesses in the cylinder head, which recesses are normally covered so as to prevent foreign matter from entering the recesses and adversely affecting the functioning of the spark plugs. As a result it has become quite difficult to reliably attach a testing device to the spark plug within its cylinder recess, and in some instances to prevent foreign matter from entering the recess during the testing operation. In addition, in order to ensure the maintenance of a proper electrical connection between the testing device and the spark plug it is desirable for that portion of the testing device which is received within the recess to be more or less firmly supported, and since spark plug recesses in different engines vary significantly in diameter, providing adequate support for the tester, thus ensuring sufficient support during the testing procedure, presents a very significant problem.

SUMMARY OF THE INVENTION

To eliminate the problems expressed above the ignition spark tester of the present invention comprises an elongated and preferably rigid element adapted to extend within cylinder head recesses so as to be operatively engaged with the exposed male contact of the spark plug and to be supported within the recess, as by frictional engagement with the inner surface of the recess. That frictional engagement is preferably provided by outwardly extending flexible vanes or equivalent structures. In order to adapt the element to be useable in connection with cylinder head recesses of relatively widely varying diameters, each end of the element so provided with a female connector and the element carries at each end flexible vanes or the like which extend out from the element to different degrees, so that by inverting the element it can reliably function with recesses of different diameters. In addition, if there is a problem preventing foreign material from entering the recess of the spark plug under test while the testing is carried out or removing such material after it has entered the recess, the element is provided with a shield member slidable along its length so that when an element is used with recesses of different depths that shield member will nevertheless engage the top of the cylinder head and close off the upper end of the recess. When, as has been described, the element is provided with ends of different external diameters, the shield member is preferably in the form of a disc having a depending skirt attached to engage the cylinder head, in which case the shield member may be removed from the element to be inverted as needed.

It is therefore a prime object of the present invention to provide an ignition tester well adapted to test spark plugs the external connectors of which are housed within recesses in the cylinder head.

It is yet another object of the present invention to provide such a tester which may be effectively used with and reliably supported in recesses of relatively widely varying internal diameters.

It is yet another object of the present invention to provide such a device with effective means for closing the open top of the recess of the spark plug being tested, and to do so effectively for recesses of widely varying depths.

It is a further object of the present invention to provide such a device which may readily be combined with other devices to constitute a kit of virtually unrestricted testing capability.

To the accomplishment of the above, and to such other objectives as may hereafter appear, the present invention relates to construction of an ignition spark tester as defined in the following claims and as described in this specification.

DESCRIPTION OF THE PREFERRED EMBODIMENTS

Figure 1:
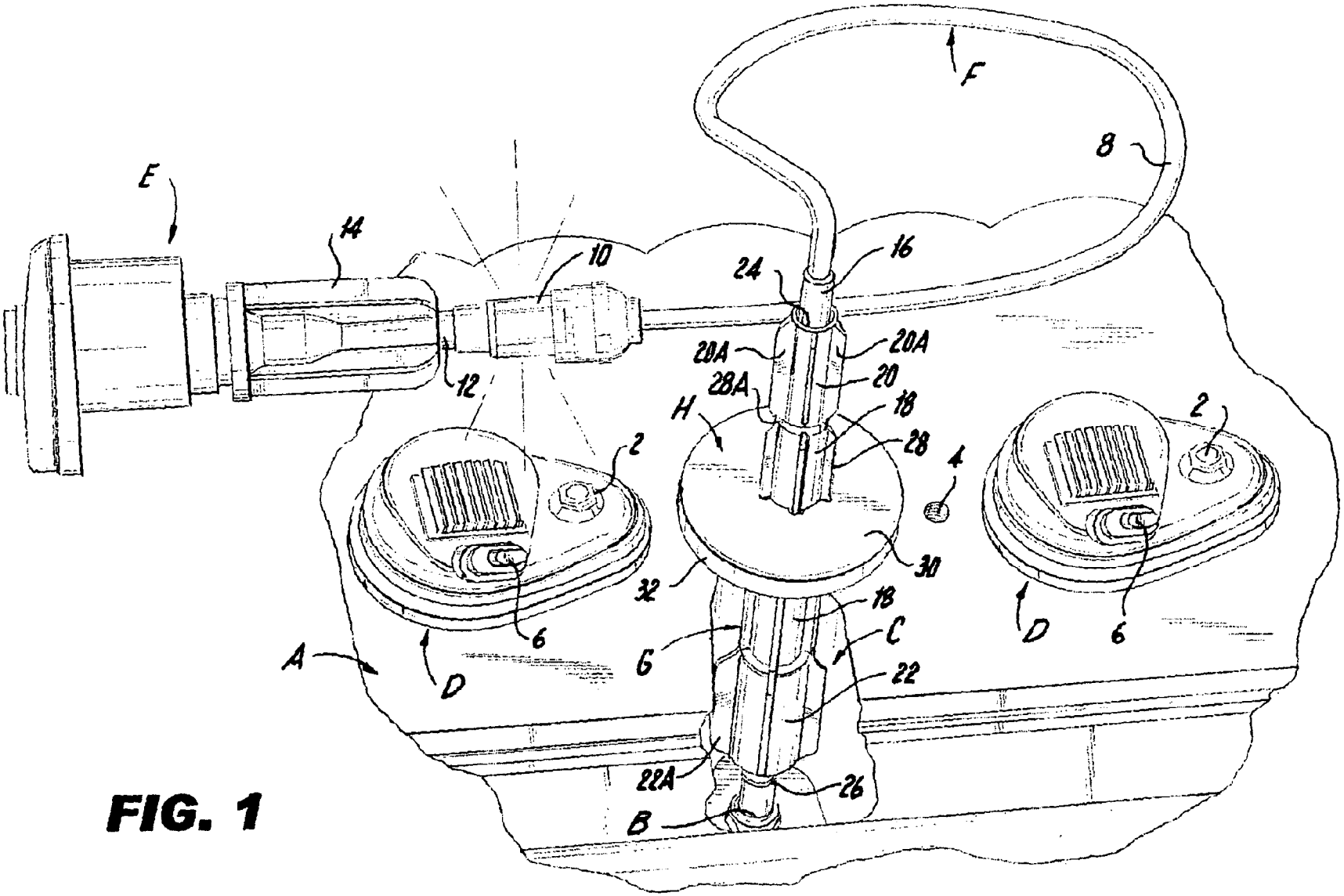
FIG. 1 is an idealized perspective view, partially broken away, of a portion of a typical cylinder head with recessed spark plugs and showing the spark plug tester of the present invention in use to test one of those spark plugs.

FIG. 1 is an idealized disclosure of a three-cylinder section of a cylinder head generally designated A. Each cylinder is provided with a spark plug generally designated B housed within a recess C in the cylinder head, and in the illustrations the cylinder head is broken away to disclose one of those spark plugs B. The other similarly housed spark plugs have their recesses closed by covers D held in place by screws 2 received within holes 4 in the top of the head A, each cover D carrying on its underside the ignition coil generally designated E for that particular spark plug B and having an external terminal 6 electrically connected to the ignition coil E. When a given spark plug is to be tested its cover D with associated ignition coil E is removed (in the illustration that is the second cylinder from the left), and the cylinder in question is ready for testing.

The testing device of the present invention comprises two parts generally designated F and G. The part F comprises a flexible conductor 8 carrying at one end a conventional ignition indicating means such as a bulb 10, and there terminating in an electrical connector 12 adapted to be detachably received on the exposed electrical contact 14 of the ignition coil E. At its other end the connector 8 carries a male electrical connector 16, and a continuous electrical circuit is defined between the connectors 12 and 16.

Figure 4:
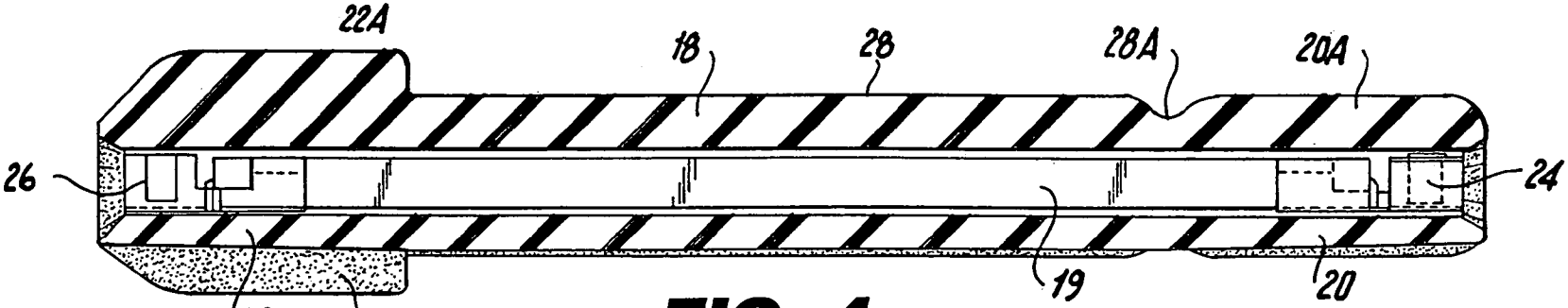
FIG. 4 is a cross-sectional view of the recess insert taken along the line 4—4 of FIG. 3.

Part G of the tester of the present invention embodies its novelty. Generally speaking, it comprises an elongated and preferably rigid or substantially rigid body 18 preferably of heat-resistant and electrically insulating material the ends 20 and 22 of which each carries female electrical connectors 24 and 26 respectively, which are appropriately electrically connected to one another through the length of the body 18 in any appropriate manner, such as by means of coiled spiral wrap wire or spark plug wire generally designated 19 on FIG. 4.

The elongated body 18 is provided with external lengthwise-extending flexible fins 28. The ends 20 and 22 of those fins are of different outer radial dimensions so that the element 18 can be snugly inserted into cylinder head recesses C of widely different internal diameters, which internal diameters differ from one automobile model to another. As here shown the end 20 is smaller than the end 22, thus enabling the element 18 to be effectively inserted end 20 foremost into recesses C smaller than those which would receive end 22. In order to provide for proper snug fit of either of the ends 20 or 22 within a particular recess C and to center the ends and to properly engage the spark plug, the fins 28 are relatively flexible, and the fin portions 20A at one end extend outwardly to a lesser distance than the fin portions 22A at the other end. The fin portions 20A and 22A are preferably separated from one another, as at 28A, so as to facilitate removal of body 18 from the cylinder head recess should twisting of the body 18 be appropriate.

In use the cover D and ignition coil E for spark plug B to be tested are removed. The element 18 is inserted into the thus exposed recess C with end 20 or 22 best suited to the size of the recess being inserted foremost, until the end connector 24 or 26, as the case may be, engages the exposed male contact 29 on the spark plug B. The other end of the element 18 will extend up from the top of the cylinder head A, and the male connector 16 of the part F is inserted into the exposed female connector 24 or 26, as the case may be, of the element 18. (In FIG. 1 it is the larger end 22 which is inserted into the recess.) Testing may then be carried out in a normal fashion, and when that testing is over the part G is removed from the recess C, the normal electrical connections of the engine are restored, and cover D is re-applied.

Because the end 20 or 22 is resiliently flexibly received within the recess C, as by engagement of the fins 20A or 22A with the internal surface of the recess C, the element 18 is well secured and supported in the recess C, thus avoiding damage to the spark plug B and ensuring continual appropriate electrical connection.

When the device of the subject invention is being used for testing it does not completely fill the opening of the recess C, normally closed by the cover D which had been removed for testing purposes. That may in some instances present a problem, in which case a shield member designated H may be carried by the part 18. That shield member is here specifically disclosed as a disc 30 having a depending skirt 32 and having a central opening 34 adapted to fit relatively snugly over and slide along body 18. When, as here specifically disclosed, the body 18 is provided with fins 28, that central opening 34 is provided with a depending flange 36 having spaced grooves 38 into which the fins 28 are slidably received. In order to permit the skirt 32 to engage the top of the recess A whether end 22 or end 24 inserted into that recess, the shield member is preferably reversibly mounted on the element 18. To that end, while the fin portions 22A at the large end of the element 18 extend radially out beyond the fin portions 20A, they extend out to a degree such that the member H may be slid off from the end 20 of the element 18 and the orientation of the shield member H can be reversed. In the drawings the skirt 32 of the shield member H is directed toward the larger end 22 by way of example.

Figure 2:
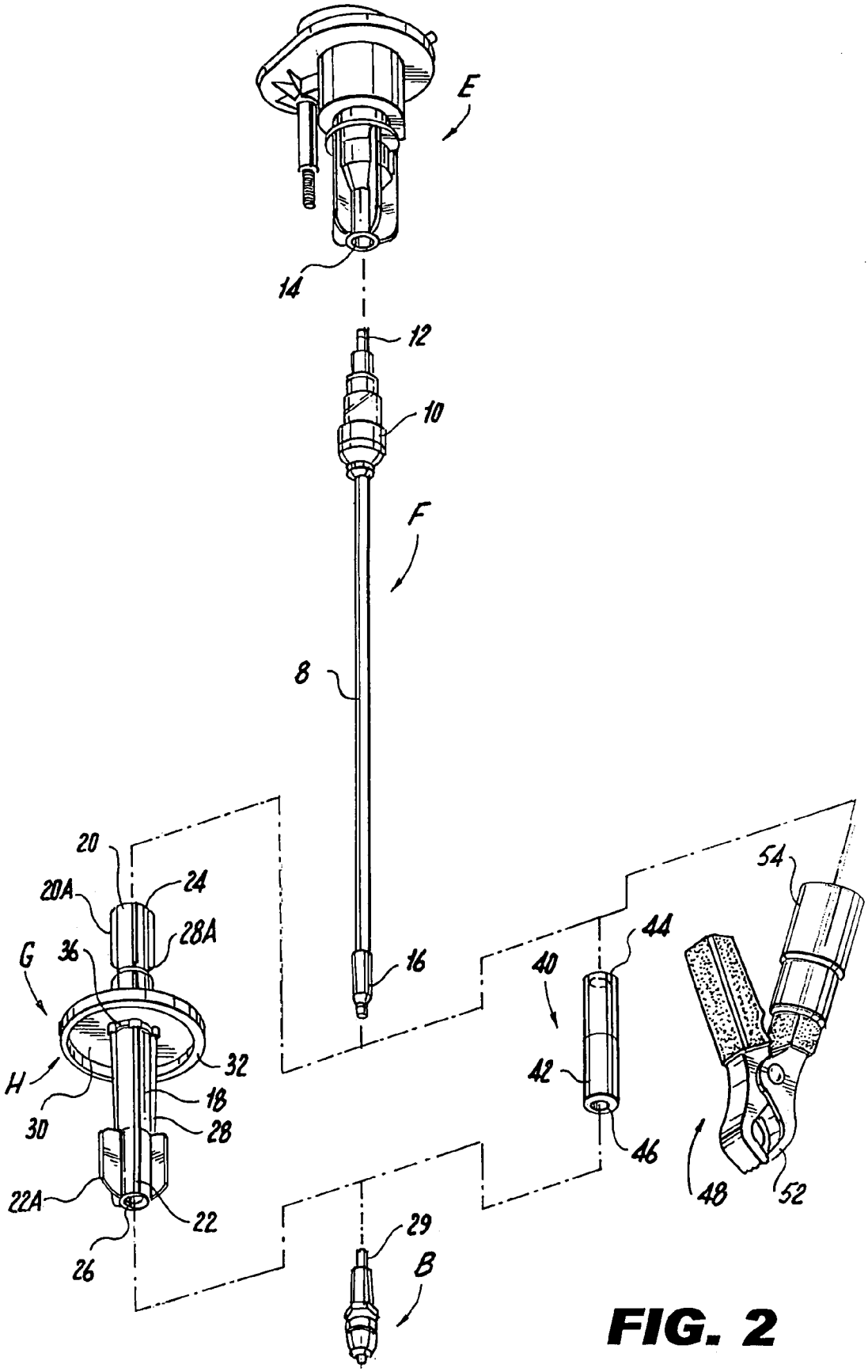
FIG. 2 is a schematic view of how the tester of the present invention may be used, either alone or in conjunction with other elements.
Figure 3:
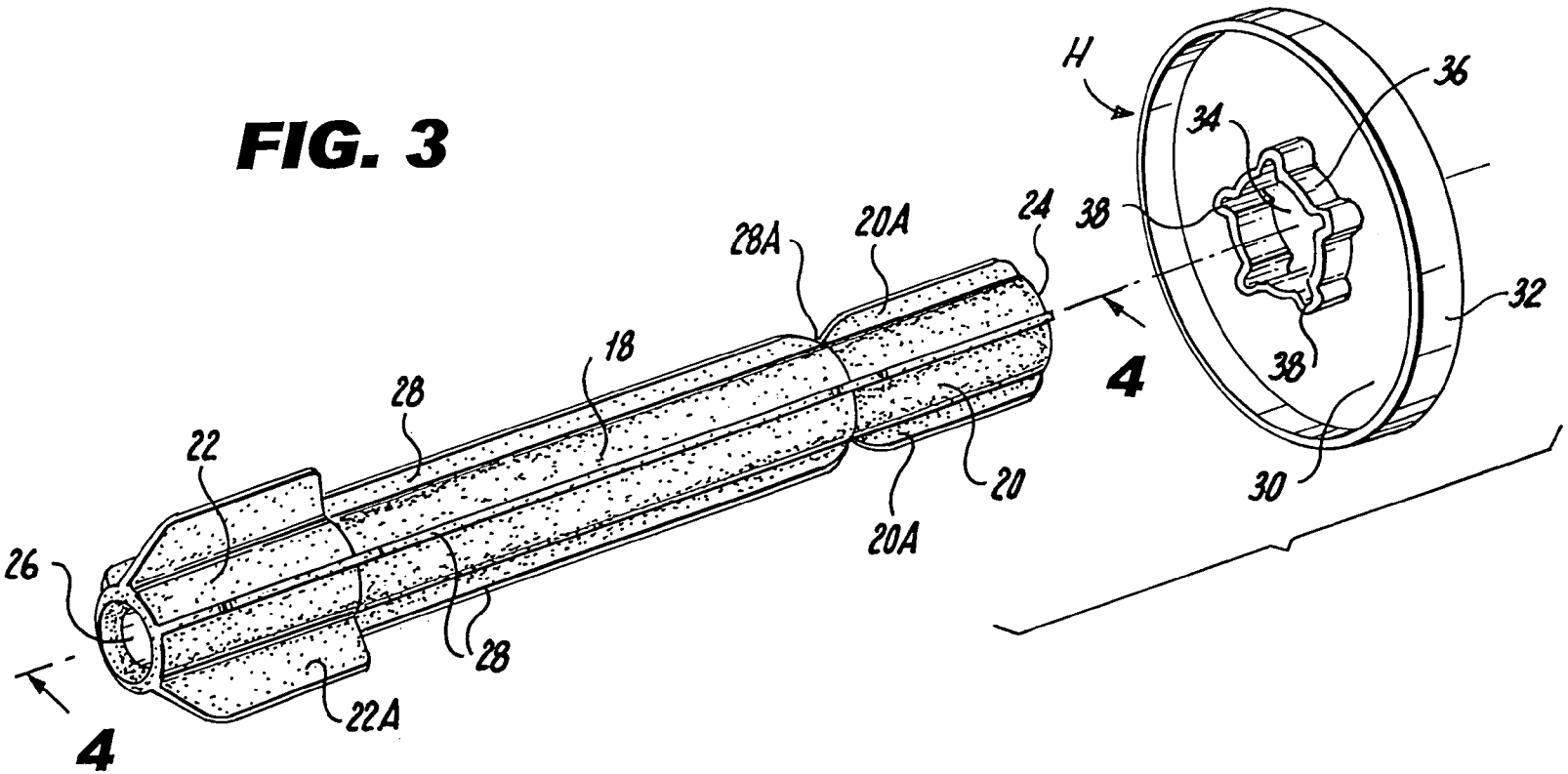
FIG. 3 is a perspective view of the novel parts of the present invention to wit, the recess insert and the shield member carried thereby.

The tester may also be provided with an adapter 40, shown in FIG. 2, for use when the spark plug B to be tested is exposed. That adapter 40 comprises an insulated electrical connector 42 having female connectors 44 and 46 at opposite ends. The part F of the tester here disclosed can be used for testing exposed spark plugs B simply by using it to connect the spark plugs with part F without using the part G.

The tester may also be provided with an adapter 48 for independent testing of the ignition coil E. The adapter 48 comprises a conventional battery clip 52 with a female receptacle 54 directly attached thereto or, if desired, connected thereto by a flexible conductor of appropriate length.

When it is desired to independently monitor the functioning of the ignition coil E the part F is connected to the ignition coil E in normal fashion, the male electrical connector 16 is plugged into the female receptacle 54, the battery clip 52 is clamped to any appropriate grounding element, and the bulb 10 in the part F will then indicate the functioning of the ignition coil E.

Thus a multi-piece testing kit may be provided consisting of parts F, G, 40 and 48 for effectively and conveniently testing spark plugs and ignition coils of virtually all automotive models past and present.

While but a single embodiment of the present invention has been here specifically disclosed, it will be apparent that many variations may be made therein, all within the scope of the invention as defined in the following claims.

I claim:

1. An ignition spark tester adapted to be electrically connected between a spark plug located at the bottom of a well in a cylinder head and an ignition system and including an ignition indication means, an improvement which comprises an elongated element carrying upper and lower exposed electrical connectors electrically connected to one another, one of said connectors being detachably connectable to a spark plug and the other of said connectors being detachably connectable to that part of said tester including said ignition indication means, said element having a width receivable in said well in snug support-producing contact with the exposed surface of said well.

2. The ignition spark tester of claim 1, in which the elongated element is substantially rigid.

3. The ignition spark tester of claim 2, in which the portion of said element adjacent at least one of said connectors is provided with outwardly extending flexible vanes, thus adapting said element to fit within cylinder head wells over a range of internal diameters.

4. An ignition spark tester adapted to be electrically connected between a spark plug located at the bottom of a well in a cylinder head and an ignition system and including an ignition indication means, the improvement which comprises an elongated element carrying upper and lower exposed electrical connectors electrically connected to one another, one of said connectors being detachable connectable to a spark plug and the other of said connectors being detachably connectable to that part of said tester including said ignition indication means, said element having a width receivable through said well in which each of said connectors is detachably connectable to a spark plug as well as to said part of said tester, said element being insertable into said well with either connector foremost.

5. The ignition spark tester of claim 4, in which portions of said element adjacent to said upper and lower connectors respectively have different external dimensions designed to fit snugly within cylinder head wells of different internal diameters respectively.

6. The ignition spark tester of claim 5, in which said portions are provided with outwardly extending flexible vanes, thus adapting said elements to frictionally fit within cylinder head wells over a range of internal diameters.

7. The ignition spark tester of any of claims 2, 4, 5 or 6, in which said elongated element further comprises a shield member slidably mounted on said element for movement along its length and comprising an outwardly extending portion adapted to engage a cylinder head so as to cover at least a portion of the opening to said well when said element is operatively engaged with a spark plug in said well.

8. The ignition spark tester of claim 7, in which said shield member comprises a body carried by said element which extends out from said element and there carries a part adapted to engage said cylinder head.

9. The ignition spark tester of claim 8, in which said body is adjustably slideable lengthwise of said body.

10. The ignition spark tester of claim 9, in which said body is removable from said element, reversible, and replaceable on said element.

11. The ignition spark tester of claim 8, in which said part adapted to engage said cylinder head is a depending skirt.

12. The ignition spark tester of claim 11, in which said body is adjustably slideable lengthwise of said body.

13. The ignition spark tester of claim 11, in which said body is removable from said element, reversible so that said skirt extends in the opposite direction, and replaceable on said element.

14. An ignition spark testing kit comprising the spark tester of any of claims 1–6 and, as an alternative connection to said ignition indication means, a battery clip and means for electrically connecting said clip to said ignition indication means, whereby said ignition indication means may be used for testing said ignition system independently of said spark plug.

* * * * *